United States Patent [19]

Smith

[11] Patent Number: 4,726,476

[45] Date of Patent: Feb. 23, 1988

[54] PRE-PACK DISPLAY STAND AND METHOD OF ERECTION

[75] Inventor: Jerrold A. Smith, Plainview, N.Y.

[73] Assignee: Arrow Art Finishers Co., Bronx, N.Y.

[21] Appl. No.: 31,024

[22] Filed: Mar. 27, 1987

[51] Int. Cl.[4] ..... A47F 5/11

[52] U.S. Cl. ..... 211/132; 206/44 R; 206/45.24; 248/174

[58] Field of Search ..... 211/132, 149, 195, 72; 206/44, 45, 45.2, 45.24; 248/174

[56] References Cited

U.S. PATENT DOCUMENTS

| | | | |
|---|---|---|---|
| 3,836,104 | 9/1974 | Miller et al. | 211/132 X |
| 4,579,220 | 4/1986 | Brundage | 206/45.24 X |
| 4,582,283 | 4/1986 | Schmitt | 211/132 X |
| 4,583,705 | 4/1986 | Schmitt | 211/132 X |

*Primary Examiner*—Robert W. Gibson, Jr.

*Attorney, Agent, or Firm*—Kirschstein, Kirschstein, Ottinger & Israel

[57] ABSTRACT

A pre-pack display stand interconnects a pre-pack tray to a self-erecting base. Upon lifting the tray above the base, the base self-erects under the action of an energy-storing element. The tray is lowered onto the erected base to complete the display.

12 Claims, 5 Drawing Figures

PRE-PACK DISPLAY STAND AND METHOD OF ERECTION

BACKGROUND OF THE INVENTION

1. Field of the Invention

This invention generally relates to a pre-pack display stand and, more particularly, to a method of erecting the same.

2. Description of Related Art

Pre-pack display stands are known in which a tray is packed in advance with articles to be displayed. A discrete stand is typically erected in situ at a retail establishment. Thereupon, the pre-pack tray is placed on the erected stand in order to display the articles contained therein.

Although generally satisfactory for its intended purpose, experience has shown that the known prepack display stands possess many disadvantages. First of all, it is very time-consuming for store personnel to erect a stand, and particularly so in the case where the personnel have not been previously trained in the correct procedure of erecting the stand. Secondly, since the stand and the tray are separate items, they are prone to being misplaced or lost. They also must be separately inventoried, shipped and paired together at the retail establishment. In addition, the tray can fall off the stand, thereby spilling the articles.

It is also known to automatically erect display stands which are not of the pre-pack type. See, for example, U.S. Pat. Nos. 4,493,424 and 4,570,805 and reissue application Ser. No. 927,549.

SUMMARY OF THE INVENTION

1. Objects of the Invention

It is a general object of this invention to overcome the drawbacks of known display stands of the pre-pack type.

It is another object of this invention to erect a prepack display stand automatically, quickly and efficiently, even by untrained personnel.

It is a further object of this invention to prevent separate inventorying, shipping and pairing of trays and stands.

Yet another object of this invention is to prevent the misplacement and/or loss of the tray and/or the stand.

Still another object of this invention is to reduce the time spent and skill involved in erecting a pre-pack display stand.

2. Features of the Invention

In keeping with these objects, and others which will become apparent hereinafter one feature of this invention resides, briefly stated, in a display stand comprising a pre-pack tray in which articles to be displayed are packed, and a base erectable from a collapsed to an erect condition. The tray is connected to the base for movement among a compact storage position in which the tray rests on and maintains the base in the collapsed condition, a lifted position in which the tray is raised above the base, and a lowered position in which the tray is lowered onto the base in the erect condition. The base is automatically erected to the erect condition in the lifted position of the tray. Means are provided on the base for supporting the tray thereon in the lowered position of the tray.

Hence, in accordance with this invention, the prepack display stand is erected in the following manner:

First, the pre-pack tray is lifted from the base in the collapsed position in which the tray maintained the base. The base is automatically erected while the tray is lifted above the base. After the base has erected itself, the tray is lowered onto the base, whereupon the erected base supports the tray.

Thus, the pre-pack stand of this invention is automatically, quickly and efficiently erected. The time spent and the skill involved in erecting the stand are at a minimum. It is no longer necessary to separately inventory, ship or match separate trays and stands, since, as stated above, the tray and stand of this invention are interconnected, preferably by a hinge panel.

In accordance with a preferred construction, the base has front and rear panels lying substantially flat against each other in the collapsed condition, and movable away from each other in mutual parallelism during erection of the base to the erect condition. The base also has side panels extending between the front and rear panels at opposite sides of the stand. Each side panel has a pair of side panel portions which lie substantially flat against each other in the collapsed condition, and which are out-folded into a coplanar state during erection of the base. A pair of support panels are provided on the base, the support panels being movable toward each other into a common plane during erection of the base. Means are provided for constantly biasing the support panels toward each other. Preferably, a circumferentially complete elastomeric band has opposite arcuate ends received in respective slots formed in the support panels. In the collapsed condition, the band is stretched to a high-tensioned state. In the erect condition, the band is returned to a less-tensioned state. All of the aforementioned panels are flat and juxtaposed with one another in the collapsed condition. The tray is advantageously provided with a flat-bottom panel lying substantially flat against the flattened panels of the base in the collapsed condition.

The support panels have first upper support surfaces. The front, rear and side panels have second upper support surfaces which, together with the first upper support surfaces, substantially lie in a support plane on which the flat-bottom panel of the tray supportably rests. The tray has a front border panel, as well as rear and side border panels, each extending generally normally of the bottom panel thereof. The side panels of the base have notches in which the front border and bottom panels of the tray are at least partially supportably received. A locking flap may be provided on and extend above the front panel. The locking flap engages the front border panel and assists in preventing the tray from falling off the base.

The tray is connected to the base by connecting means, including a hinge flap or panel. The hinge flap has one hinge section secured to the base, and an opposite hinge section secured to the bottom panel of the tray. These hinge sections are pivotable relative to each other about a hinge axis among the aforementioned tray positions.

The novel features which are considered as characteristic of the invention are set forth in particular in the appended claims. The invention itself, however, both as to its construction and its method of operation, together with additional objects and advantages thereof, best will be understood from the following description of specific embodiments when read in connection with the accompanying drawings.

DETAILED DESCRIPTION OF THE PREFERRED EMBODIMENT

Figure 2:
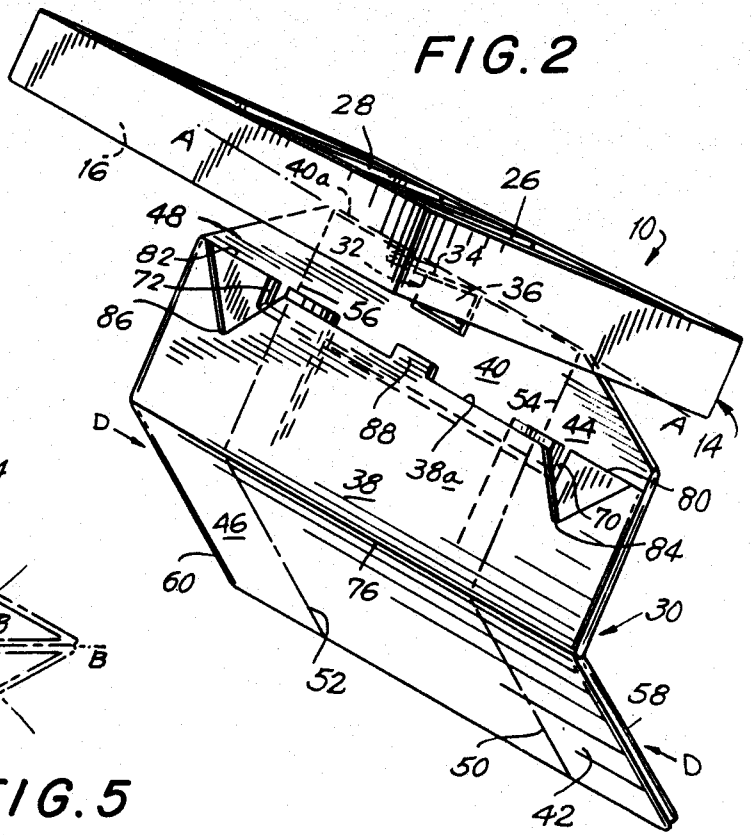
FIG. 2 is a front perspective view of the display stand of FIG. 1 in a lifted position of the tray during erection.
Figure 1:
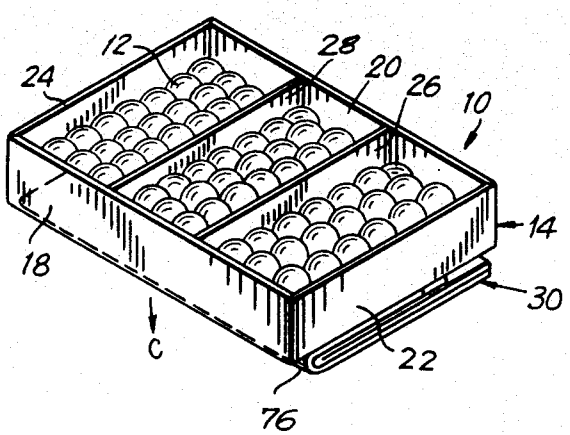
FIG. 1 is a front perspective view of a pre-pack display stand in a collapsed condition with a tray in a compact storage position in accordance with this invention.
Figure 4:
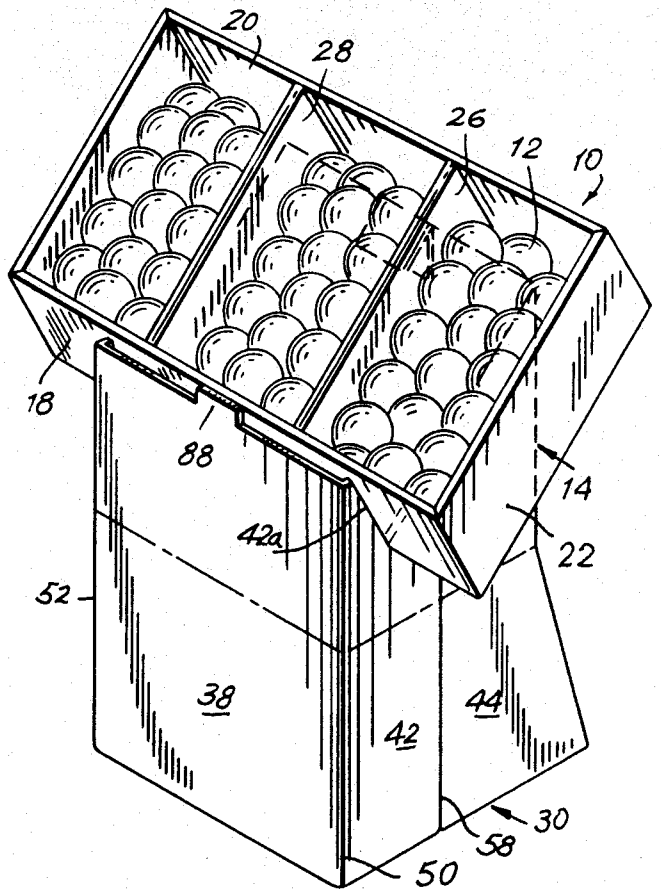
FIG. 4 is a front perspective view of the display stand of FIG. 1 in the erect condition with the tray in a lowered position.

Referring now to the drawings, reference numeral 10 generally identifies a pre-pack display stand, shown in a fully-collapsed condition in FIG. 1, and in a fully-erect condition in FIG. 4. The FIG. 4 condition shows the stand in its intended position of use, wherein articles 12, shown for the sake of simplicity as balls, are on display. The display stand 10 is shown in two intermediate conditions in FIGS. 2 and 3 during the course of erecting the stand.

The stand 10 includes a tray 14 having a flat bottom panel 16, a front border panel 18, a rear border panel 20, and two side border panels 22, 24. The border panels each extend perpendicularly of the bottom panel 16, and together form a rectangular border surrounding the entire perimeter of bottom panel 16. The articles 12 are placed on bottom panel 16 and confined in the tray by the border panels. Partition panels 26, 28 subdivide the interior of the tray for sorting the articles.

Stand 10 also includes a base 30 erectable from a collapsed to an erect condition. The tray 14 is pivotably connected to the base 30 by means of a hinge panel or flap 32 having one hinge section 34 fixedly secured, e.g. by glueing or stapling, to the bottom tray panel 16, and another hinge section 36 similarly fixedly secured to the base 30. The hinge sections 34, 36 are angularly movable in a circumferential direction about hinge axis A-A which extends along a fold line of the hinge 32. As described in greater detail below, the tray 14 is pivotable upwardly, and is lifted manually above the base (see FIG. 2), and is pivotable downwardly and lowered onto the base (see FIG. 3).

Figure 3:
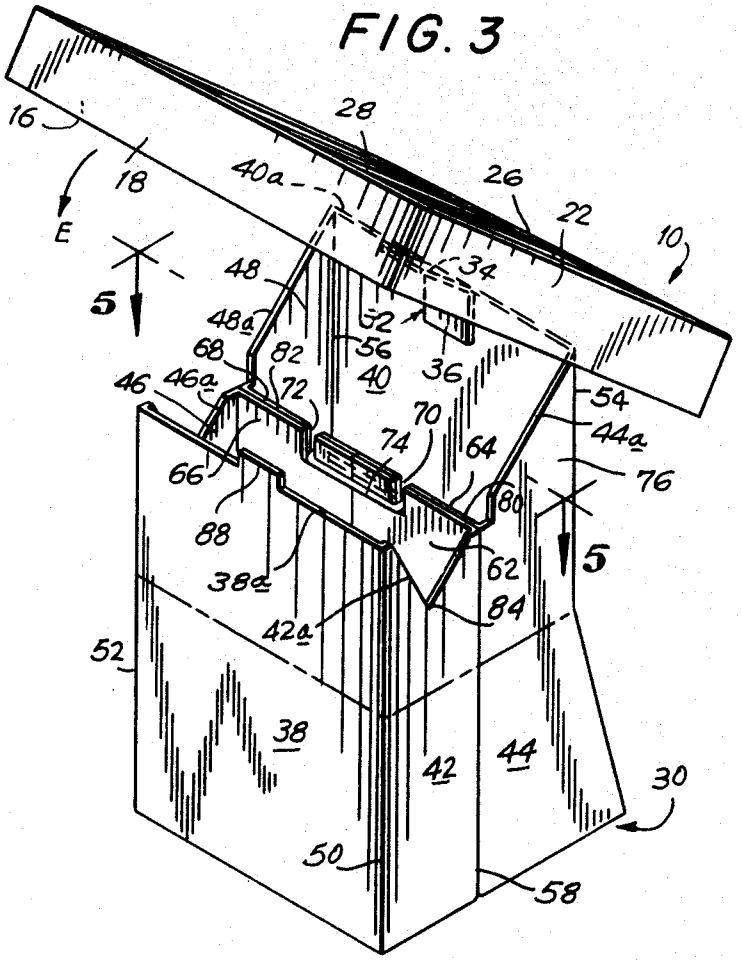
FIG. 3 is a front perspective view of the display stand of FIG. 1 with the base in a fully-erected condition.

As best shown in FIG. 3, the base 30 includes a front panel 38 and a rear panel 40 lying substantially flat against each other in the collapsed condition (FIG. 1), and movable away from each other in mutual parallelism during erection of the base to the erect condition (FIG. 3). The base 30 also includes side panels extending between the front and rear panels at opposite sides of the stand. Each side panel includes a pair of side panel portions 42, 44 and 46, 48. Each side panel portion pair lies substantially flat against each other in the collapsed condition, and are out-folded from each other in a coplanar state during erection of the base. In the erect condition, the coplanar side panel portions 42, 44 extend generally parallel to the coplanar side panel portions 46, 48.

Figure 5:
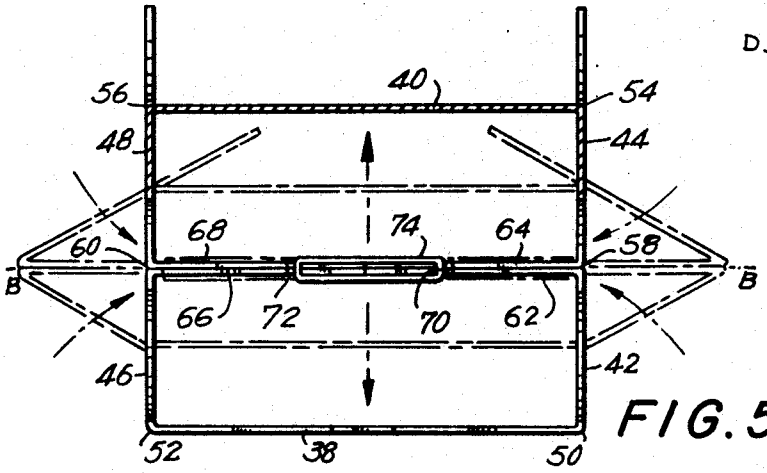
FIG. 5 is a cross-sectional view taken on line 5—5 of FIG. 3.

Front panel 38 is hinged to side panel portions 42, 46 along fold lines 50, 52. Rear panel 40 is hinged to side panel portions 44, 48 along fold lines 54, 56. Side panel portions 42, 44 meet and are foldable about upright fold line 58. Side panel portions 46, 48 meet and are foldable about upright fold line 60. As best shown in FIG. 5, the fold lines 58, 60 lie in a common plane B-B. The front and rear panels are movable toward and away from said common plane B-B with concomitant folding of the side panels onto each other, and unfolding of the side panels into respective coplanar states, respectively.

A pair of support panels, each constituted of a pair of support panel portions 62, 64 and 66, 68, are hinged to side panel portions 42, 44 and 46, 48, respectively (see FIG. 5). Support panel portions 62, 64 are coplanar with support panel portions 66, 68, and lie in the common plane B-B. Support panel portions 62, 64 are located further apart from support panel portions 66, 68 in the collapsed condition, and are moved closer to support panel portions 66, 68 in the erect condition.

Slots 70 are formed through upper marginal portions of support panel portions 62, 64. Slots 72 are formed through upper marginal portions of support panel portions 66, 68. A circumferentially complete elastomeric band 74, preferably a rubber band, has opposite arcuate ends frictionally received and maintained in slots 70, 72. Band 74 is stretchable between a high-tensioned stretched state in the collapsed condition wherein the support panel portion pairs 62, 64 and 66, 68 are spaced apart, and a less-tensioned state in the erect condition wherein the support panel portion pairs are located closer together. The energy stored in the stretched band 74 constantly urges the support panel portion pairs together.

Hence, unless restrained by an outside holding force, the band 74 serves as a biasing means operative for urging the support panel portion pairs together and, in turn, to unfold the side panel portion pairs to their respective coplanar states wherein the side panels are in mutual parallelism. In turn, the biasing means moves the front and rear panels away from each other until the erect condition of the base shown in FIGS. 3 and 4 is obtained. The outside holding force could be provided by non-illustrated clamping or similar holding means. Alternatively, the base 30 can be provided with a transverse fold line or crease 76 which divides the base into an upper part and a lower part. By folding the upper flattened base above crease 76 onto and into flat engagement with the lowered flattened part of the base below crease 76 and, thereupon, by resting the tray 14, preferably with the articles pre-packed therein, against the juxtaposed upper and lower parts of the stand, the weight of the tray, as well as the weight of the articles packed therein, acting in the direction of arrow C in FIG. 1, is sufficient to maintain the base in the illustrated compact storage position shown in FIG. 1 without risk that the base 30 will automatically pop open and erect itself under the influence of the biasing means.

The pre-pack tray with the base folded flat underneath the same is shipped in the orientation shown in FIG. 1 to a display site. Once it is desired to erect a display stand at the display site, it is merely necessary to manually lift the tray 14 up above the folded base 30. By removing the downwardly directed force acting to maintain the base in the collapsed condition, the base 30 is free to erect itself by unfolding and deploying the panels under the biasing action of the band 74 which acts in the directions of arrows D in FIG. 2. The base 30 having been fully erected, the tray 14 may now be lowered in the direction of arrow E in FIG. 3 onto the erected base. The tray is automatically centered on the base. The tray cannot be mounted off-center or laterally shifted on the base due, primarily, to the hinge panel 32.

Each of the base panels has an upper edge or support surface on which the tray is supported. Thus, front panels 38, 40 have upper support surfaces 38*a* 40*a*. Side panel portions 42, 44, 46, 48 have upper support surfaces 42*a*, 44*a*, 46*a*, 48*a*, respectively. All of the aforementioned support surfaces bound a four-sided support on which the tray can be reliably supported from below without tipping either in the front-to-back or side-to-side directions. In addition, the support panels have upper support surfaces 80, 82 which advantageously may contact the bottom panel 16 of the tray and help support the same across its middle.

For increased support, upper support surfaces 42*a*, 46*a* can be notched at 84, 86 in order to engage the front border panel 18 at opposite lateral end regions thereof and to engage, at least in part, the bottom panel 16. Still further, not only is the back of the tray held in position by hinge panel 32 and thereby prevented from sliding downwardly or falling off the base, but, also, the front of the tray is held in position by a locking flap 88 of one piece with and extending above the upper support surface 38*a* of the front panel 38. The locking flap 88 engages the front border panel 18 and effectively locks the tray in place, a situation best shown in FIG. 4. Advantageously, the upper support surfaces of the base are inclined relative to the horizontal so that the tray itself is supported on an incline. The angle of inclination of the tray is advantageously chosen to provide maximum eye-catching appeal for the articles on display.

To collapse the stand, one need only lift the tray above the base, collapse the base along plane B-B by stretching the band, folding the base about crease 76, and placing the tray back onto the folded base. The collapsed stand can now be conveniently discarded or re-packed as desired.

The tray itself, as well as the display stand, may be constituted of cardboard or corrugated board.

It will be understood that each of the elements described above, or two or more together, also may find a useful application in other types of constructions differeing from the types described above.

While the invention has been illustrated and described as embodied in a pre-pack display stand and method of erection, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A display stand, comprising:

(a) a pre-pack tray in which articles to be displayed are packed;

(b) a base erectable from a collapsed to an erect condition;

(c) means connecting the tray to the base for movement among a compact storage position in which the tray rests on and maintains the base in the collapsed condition, a lifted position in which the tray is raised above the base, and a lowered position in which the tray is lowered onto the base in the erect condition;

(d) means on the base for automatically erecting the base to the erect condition in the lifted position of the tray; and (e) means on the base for supporting the tray on the base in the lowered position of the tray.

2. The display stand as recited in claim 1, wherein the base has juxtaposed flat panels in the collapsed condition, and wherein the tray has a flat bottom panel juxtaposed and lying substantially flat against the flat panels of the base in the collapsed condition.

3. The display stand as recited in claim 2, wherein the base has front and rear panels lying substantially flat against each other in the collapsed condition, and movable away from each other in mutual parallelism during erection of the base to the erect condition.

4. The display stand as recited in claim 3, wherein the base has side panels extending between the front and rear panels at opposite sides of the stand, each side panel having a pair of side panel portions lying substantially flat against each other in the collapsed condition, and out-folded into a coplanar state.

5. The display stand as recited in claim 4, wherein the erecting means includes a pair of support panels movable toward each other in a common plane during erection of the base to the erect condition, and means for constantly biasing the support panels toward each other.

6. The display stand as recited in claim 5, wherein the support panels are provided with slots, and wherein the biasing means includes a circumferentially-complete, elastomeric band having opposite arcuate ends received in the slots, said band being stretched to a high-tensioned state in the collapsed condition, and being returned to a less-tensioned state in the erect condition.

7. The display stand as recited in claim 6, wherein the support panels have first upper support surfaces, and wherein the front, rear and side panels have second upper support surfaces which together with the first upper support surfaces substantially lie in a support plane on which the flat bottom panel of the tray supportably rests.

8. The display stand as recited in claim 7, wherein the tray has a front border panel extending generally normally of the tray bottom panel, and wherein the side panels have notches in which the front border and bottom panels of the tray are at least partially supportably received.

9. The display stand as recited in claim 8, wherein the base includes a locking flap extending above the front panel and engaging the front border panel.

10. The display stand as recited in claim 2, wherein the connecting means is a hinge flap having one hinge section secured to the base, and an opposite hinge section secured to the bottom panel of the tray, said hinge sections being pivotable about a hinge axis among the positions of the tray.

11. A method of erecting a pre-pack display stand, comprising the steps of:

(a) pre-packing articles to be displayed in a tray;

(b) collapsing a foldable base to a collapsed condition;

(c) connecting the tray to the base;

(d) resting the tray on the collapsed base to maintain the base in the collapsed condition;

(e) lifting the tray from the collapsed base while maintaining the tray connected to the base;

(f) automatically erecting the base to an erect condition while the tray is lifted above the base; and (g) lowering the tray onto the base to support the tray in the erect condition.

12. The method as recited in claim 11, wherein the tray is pivotably connected to the base for angular movement about a hinge axis, and wherein the lifting and lowering steps are manually performed by pivoting the tray in opposite circumferential directions about the hinge axis.

* * * * *